US012251036B2

(12) United States Patent
Jeon

(10) Patent No.: US 12,251,036 B2
(45) Date of Patent: Mar. 18, 2025

(54) DETACHABLE STRAW

(71) Applicant: Joo Yub Jeon, Seoul (KR)

(72) Inventor: Joo Yub Jeon, Seoul (KR)

( * ) Notice: Subject to any disclaimer, the term of this patent is extended or adjusted under 35 U.S.C. 154(b) by 553 days.

(21) Appl. No.: 17/506,267

(22) Filed: Oct. 20, 2021

(65) Prior Publication Data

US 2022/0031102 A1 Feb. 3, 2022

Related U.S. Application Data

(63) Continuation of application No. PCT/KR2020/005413, filed on Apr. 24, 2020.

(30) Foreign Application Priority Data

Apr. 24, 2019 (KR) ..... 10-2019-0047894
Apr. 16, 2020 (KR) ..... 10-2020-0045687

(51) Int. Cl.
*A47G 21/18* (2006.01)

(52) U.S. Cl.
CPC ..... *A47G 21/18* (2013.01); *A47G 2200/106* (2013.01); *A47G 2400/02* (2013.01)

(58) Field of Classification Search
CPC ..... A47G 21/18; A47G 2200/10; A47G 2200/106; A47G 2023/0666
See application file for complete search history.

(56) References Cited

U.S. PATENT DOCUMENTS 6,305,656 B1 * 10/2001 Wemyss ..... B60R 11/0241 220/628
2018/0160831 A1 * 6/2018 Yoo ..... A47G 21/18
2020/0138216 A1 * 5/2020 Phan ..... A47G 21/18
2020/0214483 A1 * 7/2020 Clark ..... A47G 21/14
2021/0315400 A1 * 10/2021 Cran ..... A47G 21/18

FOREIGN PATENT DOCUMENTS

AU 2018100814 A4 7/2018
JP 2005-046237 A 2/2005
JP 2014-155524 A 8/2014
JP 2018-157889 A 10/2018
KR 10-2016-0146521 A 12/2016
KR 10-2016-0146533 A 12/2016
KR 10-2018-0001331 A 1/2018
KR 10-1861432 B1 5/2018

OTHER PUBLICATIONS

International Search Report issued in PCT/KR2020/005413; mailed Jul. 27, 2020.

* cited by examiner

*Primary Examiner* — Tuongminh N Pham
(74) *Attorney, Agent, or Firm* — Studebaker Brackett PLLC

(57) ABSTRACT

The present invention relates to a detachable straw, and more particularly, to a detachable straw formed by simply assembling and disassembling two members having the same shape using a magnetic force.

3 Claims, 5 Drawing Sheets

DETACHABLE STRAW

CROSS-REFERENCE TO RELATED APPLICATION

This application is a continuation of International Patent Application No. PCT/KR2020/005413, filed on Apr. 24, 2020, which claims priority to and the benefit of Korean Patent Application No. 10-2019-0047894, filed on Apr. 24, 2019, and Korean Patent Application No. 10-2020-0045687, filed on Apr. 16, 2020, the disclosure of which is incorporated herein by reference in its entirety.

BACKGROUND

1. Field of the Invention

The present invention relates to a detachable straw, and more particularly, to a detachable straw formed by simply assembling and disassembling two members having the same shape using a magnetic force.

2. Discussion of Related Art

As environmental concerns of people about plastic overuse have increased, the number of people interested in eco-friendly products has increased. Also, governments recognizing that environmental issues caused by plastic overuse are socially serious tend to enforce restrictions on use of a variety of plastic products in some coffee shops, fast-food cafes, and the like.

For example, some famous coffee shops provide a container with a lid openable to drink depending on types of drinks or provide a paper straw to replace a plastic straw.

Additionally, general consumers have gradually become interested in paper straws or semipermanently usable silicone straws, stainless steel straws, and the like. However, it is important to maintain cleanliness inside a reusable straw, but in the case of straws, an internal space thereof is narrow and difficult to clean.

SUMMARY OF THE INVENTION

The present invention is directed to providing a detachable straw capable of being disassembled to be cleaned after use so as to maintain cleanliness in an internal space of the straw.

The present invention is directed to providing a detachable straw which is easy to assemble and disassemble such that an ordinary user does not find it difficult to assemble or disassemble the straw.

According to an aspect of the present invention, there is provided a detachable straw including at least two members including two longer sides corresponding to each other. Here, the two longer sides of any one of the at least two members come into contact with the two longer sides of the other of the at least two members. An upper end opening and a lower end opening are defined through coupling between the at least two members, and a hollow, through which a solution passes, is formed through the upper end opening and the lower end opening. At least one protruding portion is provided in at least one region of one longer side of the member, and at least one accommodation portion is provided in at least one region of the other longer side of the member. Also, the one member and the other member of the at least two members are fixed to each other by a magnetic force while the protruding portion is inserted into the accommodation portion.

The protruding portion may extend along an extension direction of the member. Accordingly, the accommodation portion corresponding to the protruding portion may also extend along the extension direction of the member.

A magnetic member may be provided inside at least one selected from the protruding portion and the accommodation portion.

For example, when the magnetic member is provided inside the protruding portion provided on one side of any one of the at least two members, a magnetic member or a metal member capable of forming a magnetic force with the magnetic member may be provided inside the accommodation portion provided on the other side of another member corresponding to the protruding portion.

In this case, a magnetic member or a metal member capable of forming a magnetic force with the magnetic member may be provided inside the accommodation portion provided on the other side of any one of the at least two member, and a magnetic member may be provided inside the protruding portion provided on one side of another member corresponding to the accommodation portion.

A plurality of magnetic members may be arranged to be spaced apart along an extension direction of the member.

The protruding portion may be provided to be separable from the member, and a magnetic member or a metal member capable of forming a magnetic force with the magnetic member may be provided inside the protruding portion.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which.

DETAILED DESCRIPTION OF EXEMPLARY EMBODIMENTS

To allow the present invention to be more easily understood, for convenience, particular terms will be defined herein. Unless defined otherwise herein, scientific terms and technical terms used herein will have meanings generally understood by one of ordinary skill in the art. Also, unless particularly designated in text, singular forms include plural forms and vice versa.

Hereinafter, a detachable straw according to the present invention will be described in detail.

Figure 1:
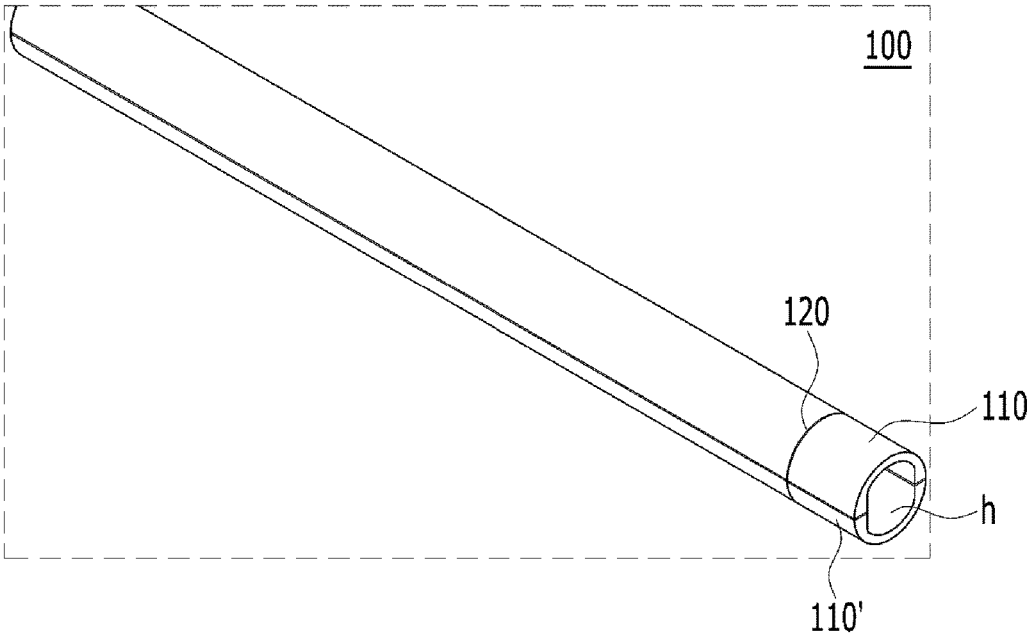
FIG. 1 is a perspective view of a detachable straw according to one embodiment of the present invention.
Figure 2:
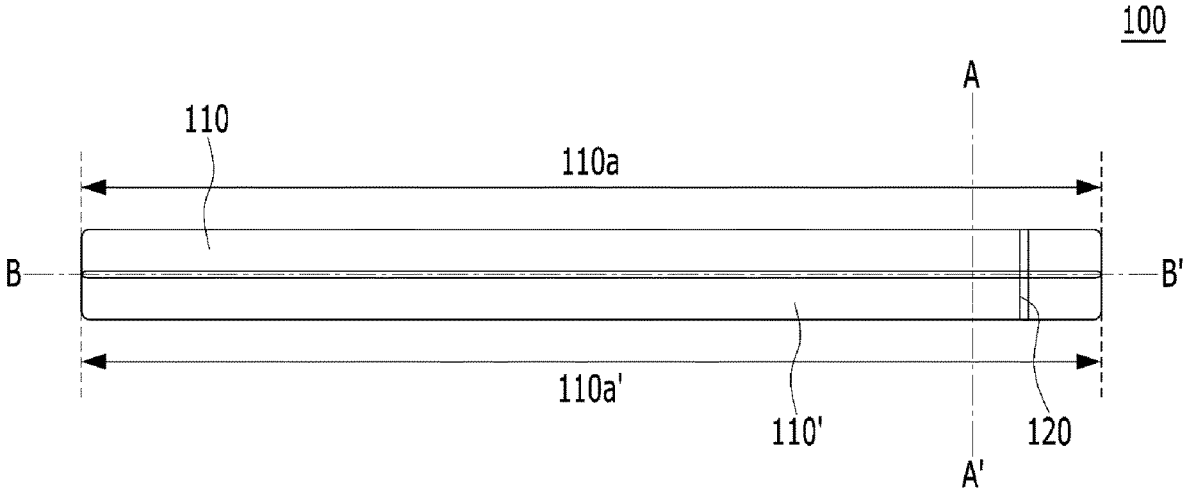
FIG. 2 is a side view of the detachable straw shown in FIG. 1.

FIG. 1 is a perspective view of a detachable straw 100 according to one embodiment of the present invention, and FIG. 2 is a side view of the detachable straw 100 shown in FIG. 1.

Referring to FIGS. 1 and 2, a detachable straw 100 according to one embodiment of the present invention may include two members 110 and 110' which include two longer sides 110*a* and 110*a'* corresponding to each other. In the attached drawings, it is shown for convenience that the straw 100 is formed by coupling the two members 110 and 110' having mutually corresponding shapes. However, without departing from a range of maintaining a coupling method between the members defined herein, the number of the members 110 and 110' which form the straw 100 may be more than two.

In one embodiment, at least two members 110 and 110' may have the same shape. That is, at least two members 110 and 110' are not classified according to male or female such that the detachable straw 100 may be assembled using only one member 110 or another member 110' of the two members 110 and 110'.

Accordingly, in the drawings, for convenience, only one of at least two members 110 and 110' will be shown. Also, unless particularly stated otherwise in the following description, it should be understand that a description related to any one of at least two members 110 and 110' is equally applied to another.

Also, hereinafter, for convenience of description, one of at least two members will be referred to as a first member 110 and another corresponding thereto will be referred to as a second member 110'.

In the detachable straw 100, two longer sides 110*a* of the first member 110 and two longer sides 110*a'* of the second member 110' may be coupled by coming into contact with each other. Here, an upper end opening h and a lower end opening (not shown) may be defined by coupling between the first member 110 and the second member 110'. Also, a hollow, through which a solution passes, may be formed through the upper end opening h and the lower end opening.

Referring to FIG. 1, a shape formed by coupling between the first member 110 and the second member 110' is a cylindrical shape with a hollow formed therein, and the upper end opening h and the lower end opening may have circular shapes but are not limited thereto.

Accordingly, the shape formed by coupling between the first member 110 and the second member 110' and the shapes of the upper end opening h and the lower end opening are not limited to the drawings and may have a variety of shapes having symmetrical sections as necessary or according to a design demand.

Also, lengths of the first member 110 and the second member 110' and sizes of the upper end opening h and the lower end opening formed by coupling between the first member 110 and the second member 110' may be determined according to a need.

Meanwhile, although not shown in the drawings, one sides of the first member 110 and the second member 110' have a curved shape such that a shape of the straw formed by coupling the first member 110 and the second member 110' may be an entirely or partially curved shape or angular shape.

Also, materials of the first member 110 and the second member 110' are not particularly limited and a variety of materials harmless to a human body to be semipermanently reused by cleaning an inside thereof, for example, wood, plastic, silicone, Teflon, stainless, an alloy, ceramics, glass, and the like may be used.

Additionally, groove portions 120 may be provided at one ends of the first member 110 and the second member 110'. The groove portions 120 are grooves recessed inward to a certain depth to fix silicone or rubber lids fitting one ends of the first member 110 and the second member 110' or to fix tips fitting one ends of the first member 110 and the second member 110' to protect.

Figure 3:
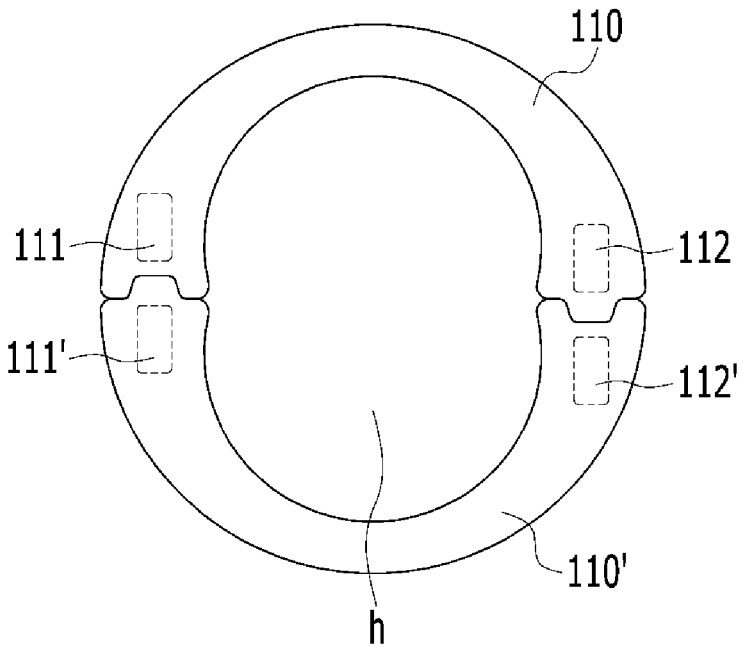
FIG. 3 is a cross-sectional view of the detachable straw according to one embodiment of the present invention taken along line A-A'.
Figure 4:
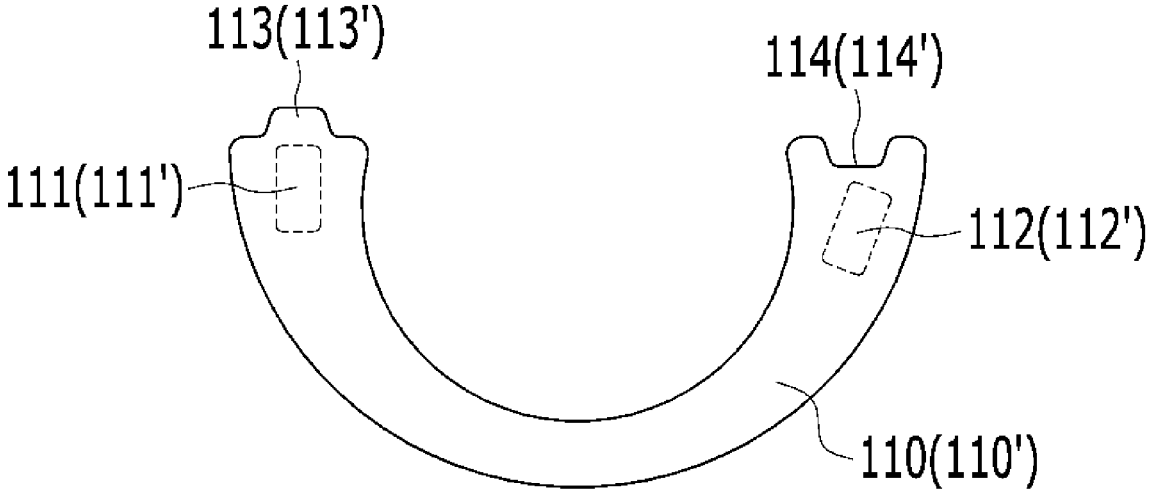
FIG. 4 is a cross-sectional view illustrating a member used in the detachable straw shown in FIG. 3.

FIG. 3 is a cross-sectional view of the detachable straw according to one embodiment of the present invention taken along line A-A', and FIG. 4 is a cross-sectional view illustrating the member used in the detachable straw shown in FIG. 3.

Referring to FIGS. 3 and 4, at least one protruding portion 113 or 113' may be provided in at least one region of one longer side 110*a* or 110*a'* of the first member 110 or the second member 110' and at least one accommodation portion 114 or 114' may be provided in at least one region of the other longer side 110*a* or 110*a'* of the first member 110 or the second member 110'.

Here, one longer side 110*a* or 110*a'* where the protruding portion 113 or 113' of the first member 110 is provided may come into contact with and be coupled to the other longer side 110*a* or 110*a'* where the accommodation portion 114 or 114' of the second member 110' is provided, and the other longer side 110*a* or 110*a'* where the accommodation portion 114 or 114' of the first member 110 is provided may come into contact with and be coupled to one longer side 110*a* or 110*a'* where the protruding portion 113 or 113' of the basic second member 110' is provided.

The protruding portions 113 and 113' provided on one longer sides 110*a* and 110*a'* of the first member 110 and the second member 110' and the accommodation portions 114 and 114' provided on the other longer sides 110*a* and 110*a'* of the first member 110 and the second member 110' may function as a sort of guide configured to form a complete straw shape as the longer sides 110*a* and 110*a'* of the first member 110 and the second member 110' come into contact with and are coupled to each other.

Also, the first member 110 and the second member 110' may be firmly coupled through insertion-coupling between the protruding portions 113 and 113' and the accommodation portions 114 and 114'. Accordingly, two coupled members may be prevented from being easily separated by an external force applied in a vertical direction or a horizontal direction of the straw 100, and a drink may be prevented from leaking from the inside of the straw 100 in use.

Here, a thickness (or width) of at least one protruding portion 113 or 113' provided on one longer side 110*a* or 110*a'* of the first member 110 may be smaller than a thickness (or width) of a cross section of one longer side 110*a* or 110*a*' of the first member 110. Also, a thickness (or width) of the accommodation portion 114 or 114' provided on the other longer side 110*a* or 110*a*' of the second member 110' for accommodating the protruding portion 113 or 113' provided on one longer side 110*a* or 110*a*' of the first member 110 may be greater than the thickness (or width) of the protruding portion 113 or 113'.

When the thickness (or width) of the protruding portion 113 or 113' is unnecessarily large, the thickness (or width) of the accommodation portion 114 or 114' should be increased according thereto. Consequently, it may be caused that thicknesses (or widths) of cross sections of the first member 110 and the second member 110' are unnecessarily increased.

Also, the thickness (or width) of at least one protruding portion 113 or 113' provided on one longer side 110*a* or 110*a*' of the first member 110 is formed to be greater than the thickness (or width) of the accommodation portion 114 or 114' provided on the other longer side 110*a* or 110*a*' of the second member 110' such that the protruding portions 113 and 113' may be accommodated in the accommodation portions 114 and 114' using a forcible fitting method. However, in this case, the accommodation portions 114 and 114' may be deformed according to materials of the first member 110 and the second member 110'. Also, forcible fitting may be impossible depending on materials of the first member 110 and the second member 110'.

Accordingly, the detachable straw according to the present application may further include means configured to provide a certain coupling force between the first member 110 and the second member 110' to be easily assembled by a user and not to separate the first member 110 from the second member 110' in use.

In one embodiment, a magnetic member 111, 111', 112, or 112' may be provided inside at least one selected from the protruding portions 113 and 113' and the accommodation portions 114 and 114'. A material of the magnetic member is not particularly limited and may be any one material capable of providing a magnetic force between the first member 110 and the second member 110'.

The magnetic members 111, 111', 112, and 112' provided inside the protruding portions 113 and 113' and the accommodation portions 114 and 114' generate a magnetic force (attraction) between the first member 110 and the second member 110' such that the first member 110 and the second member 110' may be fixed to each other by the magnetic force generated by the magnetic members while the protruding portions 113 and 113' are inserted in the accommodation portions 114 and 114'.

For example, when the magnetic members are provided inside the protruding portions 113 and 113' provided on one side of the first member 110, the magnetic members or metal members capable of forming a magnetic force with the magnetic members may be provided inside the accommodation portions 114 and 114' of the second member 110' which correspond to the protruding portions 113 and 113' of the first member 110. Here, when the magnetic members are provided inside the accommodation portions 114 and 114' of the second member 110', the magnetic members should have a polarity opposite that of the magnetic members provided inside the protruding portions 113 and 113' of the first member 110.

Magnetic members or metal members capable of forming a magnetic force with the magnetic members may be provided inside the accommodation portions 114 and 114' provided on the other side of the first member 110, and magnetic members may be provided inside the protruding portions 113 and 113' of the second member 110' corresponding to the accommodation portions 114 and 114' of the first member 110. Here, when the magnetic members are provided inside the accommodation portions 114 and 114' of the first member 110, the magnetic members should have a polarity opposite that of the magnetic members provided inside the protruding portions 113 and 113' of the second member 110'.

Also, shapes, sizes, and alignment angles of the magnetic members provided inside the protruding portions 113 and 113' and/or the accommodation portions 114 and 114' may be adjusted as necessary. For example, referring to FIG. 4, the magnetic members 112 and 112' may be provided in a tilted manner along curved directions of the members 110 and 110'.

Figure 5:
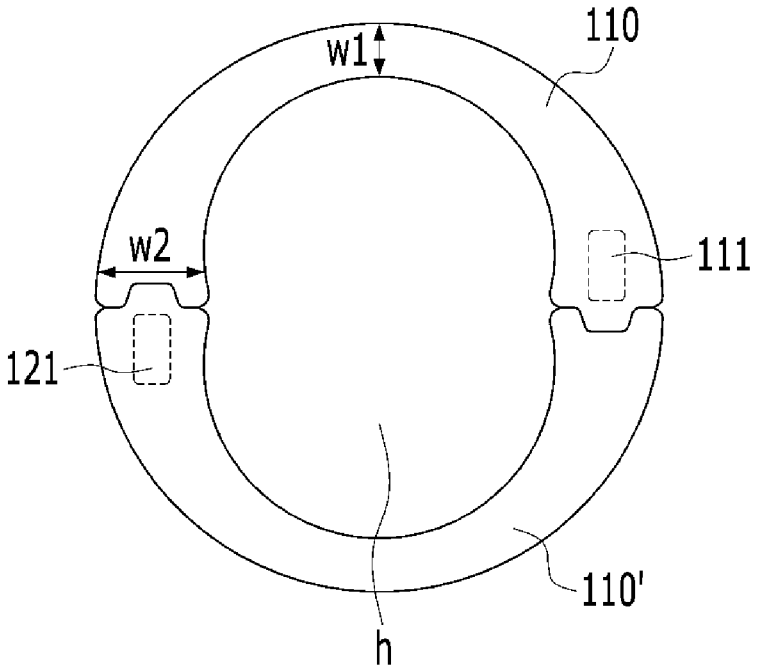
FIG. 5 is a cross-sectional view illustrating a member used in the detachable straw according to another embodiment of the present invention taken along line A-A'.

Meanwhile, as shown in FIG. 5, when at least one of the first member 110 and the second member 110' has conductivity, a magnetic force may be generated between the first member 110 and the second member 110' by providing a magnetic member in at least one of the first member 110 and the second member 110'.

For example, when the first member 110 and the second member 110' have conductivity, magnetic members are provided in the protruding portions 113 and 113' provided on one side of the first member 110 and the protruding portions 113 and 113' provided on one side of the second member 110' such that attraction may occur between the first member 110 and the second member 110' to fix the first member 110 and the second member 110'.

Also, in another case, when the first member 110 has conductivity, magnetic members are provided inside the accommodation portions 114 and 114' and the protruding portions 113 and 113' of the second member 110' corresponding to the protruding portions 113 and 113' provided on one side of the first member 110 and the accommodation portions 114 and 114' provided on the other side of the first member 110 such that attraction may occur between the first member 110 and the second member 110' to fix the first member 110 and the second member 110'.

Additionally, a thickness of the member may gradually increase from a center of the member toward the region where the protruding portions 113 and 113' or the accommodation portions are provided. According to a gradient of the thickness, it is possible to secure an adequate internal space while the first member 110 and the second member 110' are coupled.

Figure 6:
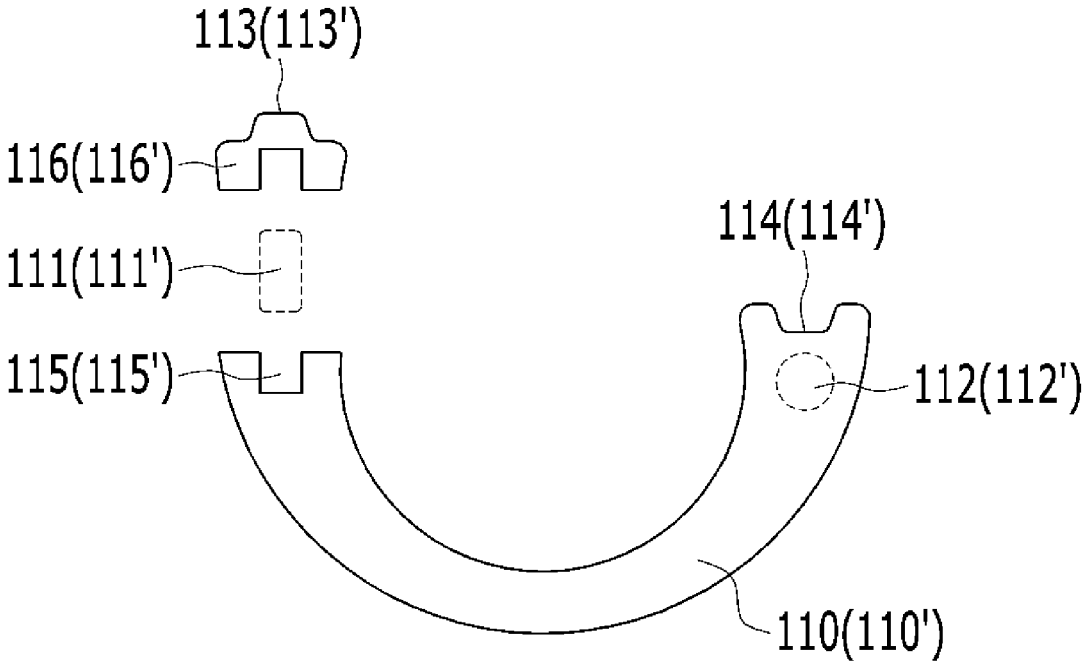
FIG. 6 is a cross-sectional view illustrating a member used in the detachable straw according to still another embodiment of the present invention taken along line A-A'.

FIG. 6 is a cross-sectional view illustrating a member used in the detachable straw according to still another embodiment of the present invention taken along line A-A'.

Referring to FIG. 6, the protruding portions 113 and 113' may be provided to be separable from the first member 110 and the second member 110'. Here, the protruding portions 113 and 113' may be formed on sub bodies 116 and 116', and the sub bodies 116 and 116' may be separated from the first member 110 and the second member 110'. Certain internal spaces 115 and 115' may be formed between the sub bodies 116 and 116' and the first member 110 and the second member 110', and magnetic members 111 and 111' or metal members configured to form a magnetic force with the magnetic members may be inserted into the internal spaces 115 and 115'.

Also, the magnetic members 112 and 112' or metal members configured to form a magnetic force with the magnetic members may be inserted into the accommodation portions 114 and 114' located on the other side of the protruding portions 113 and 113'. Meanwhile, when the first member 110 and/or the second member 110' has conductivity, the magnetic members or the metal members inside the accommodation portions 114 and 114' may be omitted.

Figure 7:
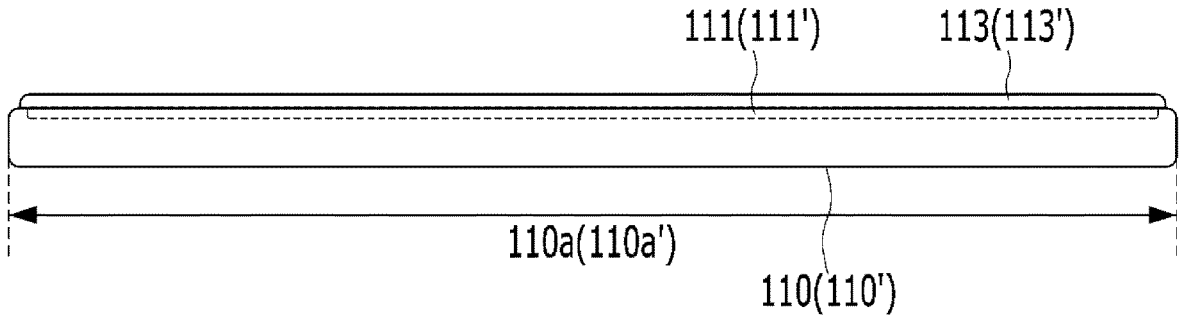
FIG. 7 is a cross-sectional view illustrating a part of the member used in the detachable straw according to one embodiment of the present invention taken along line B-B'.

FIG. 7 is a cross-sectional view illustrating a part of the member used in the detachable straw according to one embodiment of the present invention taken along line B-B'.

Referring to FIG. 7, the protruding portions 113 and 113' and the accommodation portions 114 and 114' may extend along extension directions of the first member 110 and the second member 110'. The magnetic members provided inside the protruding portions 113 and 113' and/or the accommodation portions 114 and 114' may also extend along the extension directions of the first member 110 and the second member 110'.

Accordingly, the first member 110 and the second member 110' may be firmly fixed through not only the insertion-coupling between the protruding portions 113 and 113' and the accommodation portions 114 and 114' but also the magnetic force generated between the first member 110 and the second member 110'. Here, a fixing force between the first member 110 and the second member 110' may be a level of being separable by a user as necessary.

Figure 8:
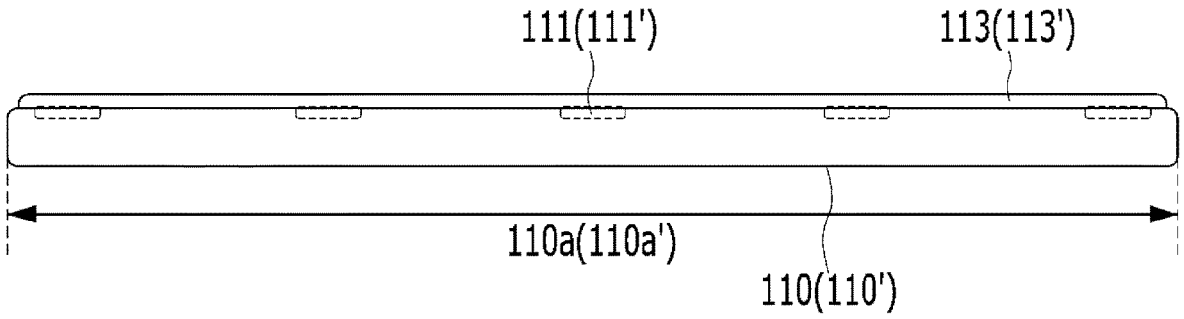
FIG. 8 is a cross-sectional view illustrating a part of the member used in the detachable straw according to another embodiment of the present invention taken along line B-B'.

Meanwhile, referring to FIG. 8 which is a cross-sectional view illustrating a part of the member used in the detachable straw according to another embodiment of the present invention taken along line B-B', a plurality of such magnetic members 111 and 111' may be arranged to be spaced apart along the extension directions of the first member 110 and the second member 110'.

Also, although not shown in the drawings, the protruding portions 113 and 113' and the accommodation portions 114 and 114' are also arranged in positions in which the plurality of magnetic members 111 and 111' are arranged or arranged alternately with the plurality of magnetic members 111 and 111' so as to provide an adequate fixing force between the first member 110 and the second member 110'.

Meanwhile, according to still another embodiment of the present invention, the protruding portions and the accommodation portions corresponding thereto are located on both ends of the first member and the second member, and magnetic members or metal members configured to form a magnetic force with the magnetic members may be provided between the protruding portions and the accommodation portions and on contact surfaces of the first member and the second member.

Figure 9:
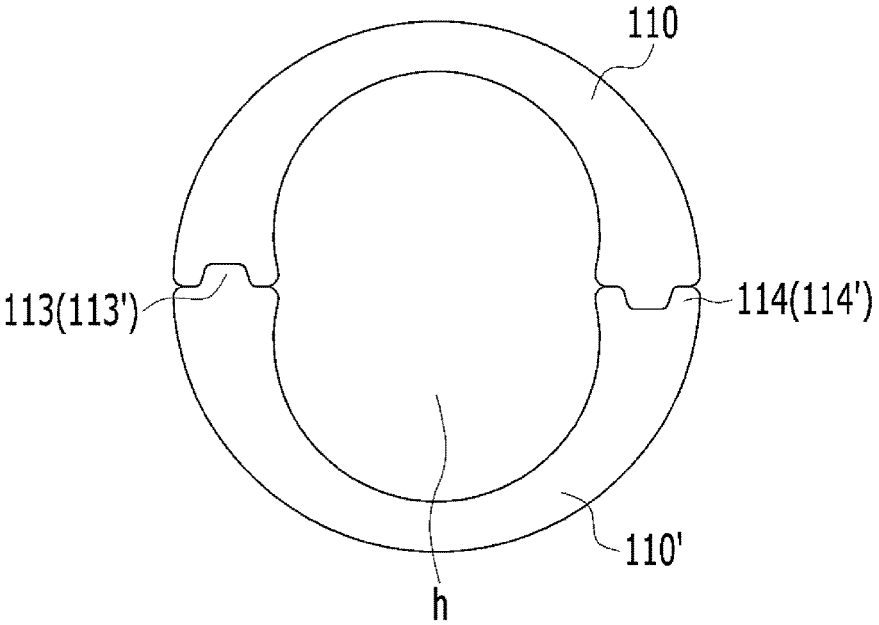
FIG. 9 is a cross-sectional view illustrating the member used in the detachable straw according to still another embodiment of the present invention taken along line A-A'.
Figure 10:
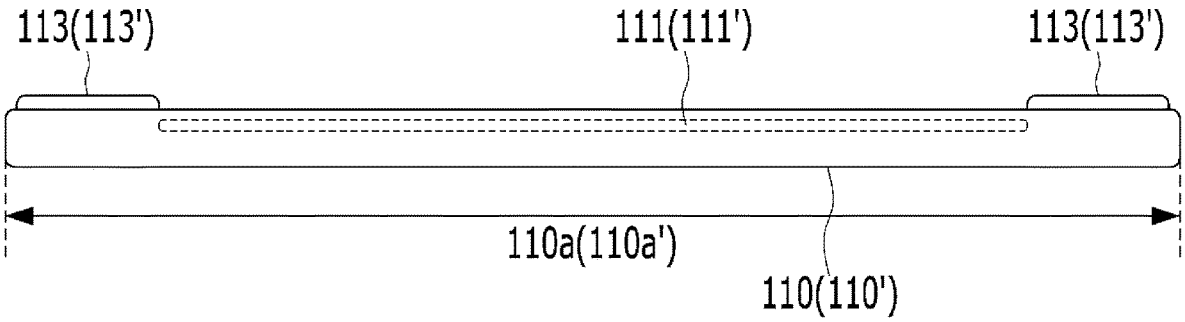
FIG. 10 is a cross-sectional view illustrating the part of the member used in the detachable straw according to still another embodiment of the present invention taken along line B-B'.

FIG. 9 is a cross-sectional view illustrating the member used in the detachable straw according to the embodiment of the present invention taken along line A-A', and FIG. 10 is a cross-sectional view illustrating a part of the member used in the detachable straw according to the embodiment of the present invention taken along line B-B'.

Referring to FIGS. 9 and 10, the protruding portions 113 and 113' and the accommodation portions 114 and 114' may be provided on both ends of the first member 110 and the second member 110'. Here, magnetic members or metal members configured to form a magnetic force with the magnetic members may be omitted inside the protruding portions 113 and 113' and the accommodation portions 114 and 114'. In place thereof, the magnetic members 111 and 111' or metal members configured to form a magnetic force with the magnetic members 111 and 111' may be provided on or inside contact surfaces of the first member 110 and the second member 110'. As necessary, the magnetic members 111 and 111' or the metal members configured to form a magnetic force with the magnetic members 111 and 111' may be provided inside the protruding portions 113 and 113' and the accommodation portions 114 and 114'.

When the magnetic members 111 and 111' are provided on the contact surfaces of the first member 110 and the second member 110', a coating layer (not shown) configured to cover the magnetic members may be formed on the magnetic members. Here, when the magnetic members 111 and 111' and coating layer covering the magnetic members 111 and 111' are provided on one surface of the first member 110 with which the second member 110' comes into contact, in order to prevent the first member 110 and the second member 110' from being fixed with a gap therebetween due to the magnetic members 111 and 111' and the coating layer, one surface of the second member 110' corresponding thereto may have a curved shape so as to accommodate the magnetic members 111 and 111' and the coating layer therein.

In the case of paper straws, it is difficult to achieve an ultimate purpose of preventing waste of resources beyond plastic overuse because it is impossible to reuse a paper straw which absorbs a liquid when being dipped into the liquid for a long time. Of course, it is seen that paper straws are reusable straws adequate for being introduced in coffee shops or fast-food cafes.

According to the present invention, there is a significance to providing a solution for ultimately overcoming limitations in a variety of types of straws such as silicone straws and stainless steel straws currently released as semipermanently reusable straws on the market rather than replacing paper straws. Even in the semipermanently usable straws, as the number of times of use increases, it becomes difficult to reuse when an internal space of a straw becomes severely contaminated.

Accordingly, according to the present invention, since it is easy to assemble or disassemble a detachable straw, it is possible to disassemble and clean the straw after use so as to maintain cleanliness in an internal space inside the straw.

Also, the detachable straw according to the present invention may be firmly coupled not only through fit-coupling a protruding portion and an accommodation portion located in coupled surfaces of two members but also through a magnetic force of magnetic materials and/or metal materials provided on the coupled surfaces of the two members. Accordingly, it is possible to prevent the coupled two members from being separated even by a weak force and to prevent a liquid from leaking from therewithin when the straw is used.

Although the embodiments of the present invention have been described above, it should be noted that one of ordinary skill in the art may make a variety of modifications and changes of the present invention by adding, changing, eliminating, inserting, or the like of components without departing from the concept of the present invention which is disclosed in the claims and they will be included within the scope of the present invention.

What is claimed is:

1. A detachable straw comprising a first member and a second member, each of which comprises two longer sides corresponding to each other, wherein the two longer sides of the first member come into contact with the two longer sides of the second member, wherein an upper end opening and a lower end opening are defined through coupling between the first member and the second member, and a hollow, through which a solution passes, is formed through the upper end opening and the lower end opening, wherein at least one protruding portion is provided in at least one region of one longer side of a respective one of the first member and the second member, and at least one accommodation portion is provided in at least one region of the other longer side of the respective one of the first member and the second member, wherein a thickness of the protruding portion is smaller than a thickness of a cross section of the respective one of the first member and the second member, wherein a width of the accommodation portion is greater than the thickness of the protruding portion, wherein a thickness of the respective one of the first member and the second member gradually increases from a center of the respective one of the first member and the second member toward a first distal end of the respective one of the first member and the second member, where the protruding portion is positioned, and the thickness of the respective one of the first member and the second member also gradually increases from the center of the respective one of the first member and the second member toward a second distal end of the respective one of the first member and the second member, where the accommodation portion is positioned, wherein a plurality of magnetic members are provided inside at least one selected from the protruding portion and the accommodation portion, wherein the first member and the second member are fixed to each other by a magnetic force while the protruding portion is inserted into the accommodation portion, wherein the protruding portion and the accommodation portion extend along an extension direction of the respective one of the first member and the second member, wherein the plurality of magnetic members are arranged along the extension direction of the respective one of the first member and the second member, and wherein each of the plurality of magnetic members is provided in a tilted manner along curved directions of the respective one of the first member and the second member.

2. The detachable straw of claim 1, wherein the plurality of magnetic members is provided inside one selected from the protruding portion and the accommodation portion, and a plurality of metal members capable of forming a magnetic force with the plurality of magnetic members are provided inside the other.

3. The detachable straw of claim 1, wherein the plurality of magnetic members extends along the extension direction of the respective one of the first member and the second member.

* * * * *